US010711530B1

(12) United States Patent
Miller et al.

(10) Patent No.: US 10,711,530 B1
(45) Date of Patent: Jul. 14, 2020

(54) CONTACT MODULE FOR COMMUNICATING WITH A DOWNHOLE DEVICE

(71) Applicant: Basin Drilling Tools LP, New York, NY (US)

(72) Inventors: Kenneth C. Miller, Houston, TX (US); David Cramer, Okotoks (CA)

(73) Assignee: Basin Drilling Tools LP, New York, NY (US)

( * ) Notice: Subject to any disclaimer, the term of this patent is extended or adjusted under 35 U.S.C. 154(b) by 0 days.

(21) Appl. No.: 16/424,183

(22) Filed: May 28, 2019

(51) Int. Cl.
*E21B 17/02* (2006.01)
*E21B 47/13* (2012.01)

(52) U.S. Cl.
CPC ..... *E21B 17/028* (2013.01); *E21B 47/13* (2020.05)

(58) Field of Classification Search
CPC ..... E21B 17/028; E21B 47/12; E21B 47/122
See application file for complete search history.

(56) References Cited

U.S. PATENT DOCUMENTS 3,976,347 A 8/1976 Cooke, Sr. et al.
5,131,464 A * 7/1992 Lenhart ..... E21B 7/04 166/65.1
5,141,051 A * 8/1992 Lenhart ..... E21B 17/028 166/65.1
5,159,978 A * 11/1992 Tomek ..... E21B 17/028 166/254.2
5,334,801 A * 8/1994 Mohn ..... E21B 17/028 166/65.1
5,820,416 A * 10/1998 Carmichael ..... E21B 17/028 439/668
6,614,718 B2 9/2003 Cecconi et al.
6,915,849 B2 7/2005 Nuth
7,074,064 B2 * 7/2006 Wallace ..... H01R 13/523 166/65.1
7,506,699 B1 3/2009 Harvey et al.
8,397,815 B2 3/2013 MacDougall et al.
2002/0060952 A1 5/2002 Cecconi et al.
2002/0170711 A1 11/2002 Nuth
2012/0048552 A1 3/2012 MacDougall et al.

FOREIGN PATENT DOCUMENTS

WO 2002086287 A2 10/2002

* cited by examiner

*Primary Examiner* — D. Andrews
(74) *Attorney, Agent, or Firm* — Dickinson Wright, PLLC; Michael E. Noe, Jr.; Jonathan H. Harder

(57) ABSTRACT

A system including a tool drill string having a downhole device. The system includes at least one external contact configured to be electrically coupled to the downhole device to communicate with the downhole device, one or more insulators that electrically insulate the at least one external contact from other parts of the system, and one or more seals situated between the one or more insulators and the at least one external contact to pressure seal the system from external fluids.

15 Claims, 9 Drawing Sheets

CONTACT MODULE FOR COMMUNICATING WITH A DOWNHOLE DEVICE

TECHNICAL FIELD

The present disclosure relates to drilling systems. More specifically, the present disclosure relates to communicating with a downhole device through a contact module that is coupled to the downhole device.

BACKGROUND

Drilling systems can be used for drilling well boreholes in the earth for extracting fluids, such as oil, water, and gas. The drilling systems include a drill string for boring the well borehole into a formation that contains the fluid to be extracted. The drill string includes tubing or a drill pipe, such as a pipe made-up of jointed sections, and a drilling assembly attached to the distal end of the drill string. The drilling assembly includes a drill bit at the distal end of the drilling assembly. Typically, the drill string, including the drill bit, is rotated to drill the well borehole. Often, the drilling assembly includes a mud motor that rotates the drill bit for boring the well borehole.

Obtaining downhole measurements during drilling operations is known as measurement while drilling (MWD) or logging while drilling (LWD). A downhole device, such as an MWD tool, is programmed with information such as which measurements to take and which data to transmit back to the surface while it is on the surface. The downhole device is then securely sealed from the environment and the high pressures of drilling and put into the well borehole. After the downhole device is retrieved from the well borehole, it is unsealed to retrieve data from the downhole device using a computer. To use the downhole device again, the device is sealed and put back into the well borehole. This process of sealing and unsealing the downhole device is time consuming and difficult, and if done wrong very expensive to fix, which increases the cost of drilling the well.

SUMMARY

In an Example 1, a system including a tool drill string having a downhole device, the system comprising at least one external contact configured to be electrically coupled to the downhole device to communicate with the downhole device, one or more insulators that electrically insulate the at least one external contact from other parts of the system, and one or more seals situated between the one or more insulators and the at least one external contact to pressure seal the system from external fluids.

Example 2 is the system of Example 1, wherein the at least one external contact is positioned on a contact module having a distal end and a proximal end and including an end shaft at the distal end configured to be connected to the downhole device, a latch rod and nose at the proximal end, and a contact shaft including the at least one external contact situated between the end shaft and the nose.

Example 3 is the system of Example 1, wherein the at least one external contact is positioned on a contact module that includes a distal end configured to be connected to a first downhole module, a proximal end configured to be connected to a second downhole module, and a contact shaft including the at least one external contact and situated between the distal end and the proximal end.

Example 4 is the system of Example 1, wherein the at least one external contact is positioned on a contact module that includes a distal end, a proximal end configured to be connected to a downhole module, and a contact shaft including the at least one external contact and situated between the distal end and the proximal end.

Example 5 is the system of Example 1, wherein the at least one external contact includes two or more annular external contacts that are electrically insulated from one another.

Example 6 is the system of Example 1, wherein the at least one external contact is positioned on a contact module configured to bear a tensile load for lifting the contact module and the downhole device.

Example 7 is the system of Example 1, wherein at least one of the one or more insulators is a ceramic insulator.

Example 8 is the system of Example 1, further comprising a surface connector including at least one surface contact configured to electrically couple with the at least one external contact.

Example 9 is the system of Example 8, wherein the surface connector includes one or more wiper seals configured to clean the at least one external contact as the surface connector is engaged with the at least one external contact.

In an Example 10, a system including a tool drill string having a downhole device. The system comprising a contact module for subsurface drilling including a first member including a central shaft; a second member configured to engage the central shaft such that the first member and the second member are secured together; and at least one contact that is electrically insulated from the first member and the second member and configured to provide electrical communications through the contact module to the downhole device, wherein the contact module includes one or more insulators that electrically insulate the at least one contact from the first member and the second member and including one or more seals situated between the one or more insulators and the at least one contact to pressure seal the contact module from external fluids.

Example 11 is the system of Example 10, wherein the first member and the at least one contact are keyed to prevent rotation of the first member in relation to the at least one contact.

Example 12 is the system of Example 10, wherein the at least one contact is configured to provide one or more of single line communications, CAN communications, RS232 communications, and RS485 communications.

Example 13 is the system of Example 10, wherein at least one of the one or more insulators is a ceramic insulator.

Example 14 is the system of Example 10, comprising a surface connector including at least one surface contact configured to contact the at least one contact of the contact module.

In an Example 15, a method of communicating with a downhole device in a tool drill string, the method comprising connecting a contact module having at least one external electrical contact into the tool drill string; coupling the contact module electrically to the downhole device; coupling the contact module to a surface connector at a surface location while maintaining the contact module and the downhole device in the tool drill string; and communicating with the downhole device through the surface connector and the contact module.

Example 16 is the method of Example 15, wherein coupling the contact module to the surface connector includes contacting the at least one external electrical contact on the contact module to one or more electrical contacts on the surface connector.

Example 17 is the method of Example 16, wherein communicating with the downhole device includes communicating through the one or more electrical contacts on the surface connector and the at least one external electrical contact on the contact module.

Example 18 is the method of Example 15, comprising cleaning the at least one external electrical contact by sliding one or more wiper seals of the surface connector over the at least one external electrical contact as the surface connector is coupled to the contact module.

Example 19 is the method of Example 15, wherein communicating with the downhole device includes communicating with the downhole device using one or more of single line communications, CAN bus communications, RS232 communications, and RS485 communications.

Example 20 is the method of Example 15, wherein communicating with the downhole device includes communicating between a surface processor and the downhole device through the contact module.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

DETAILED DESCRIPTION

Figure 1:
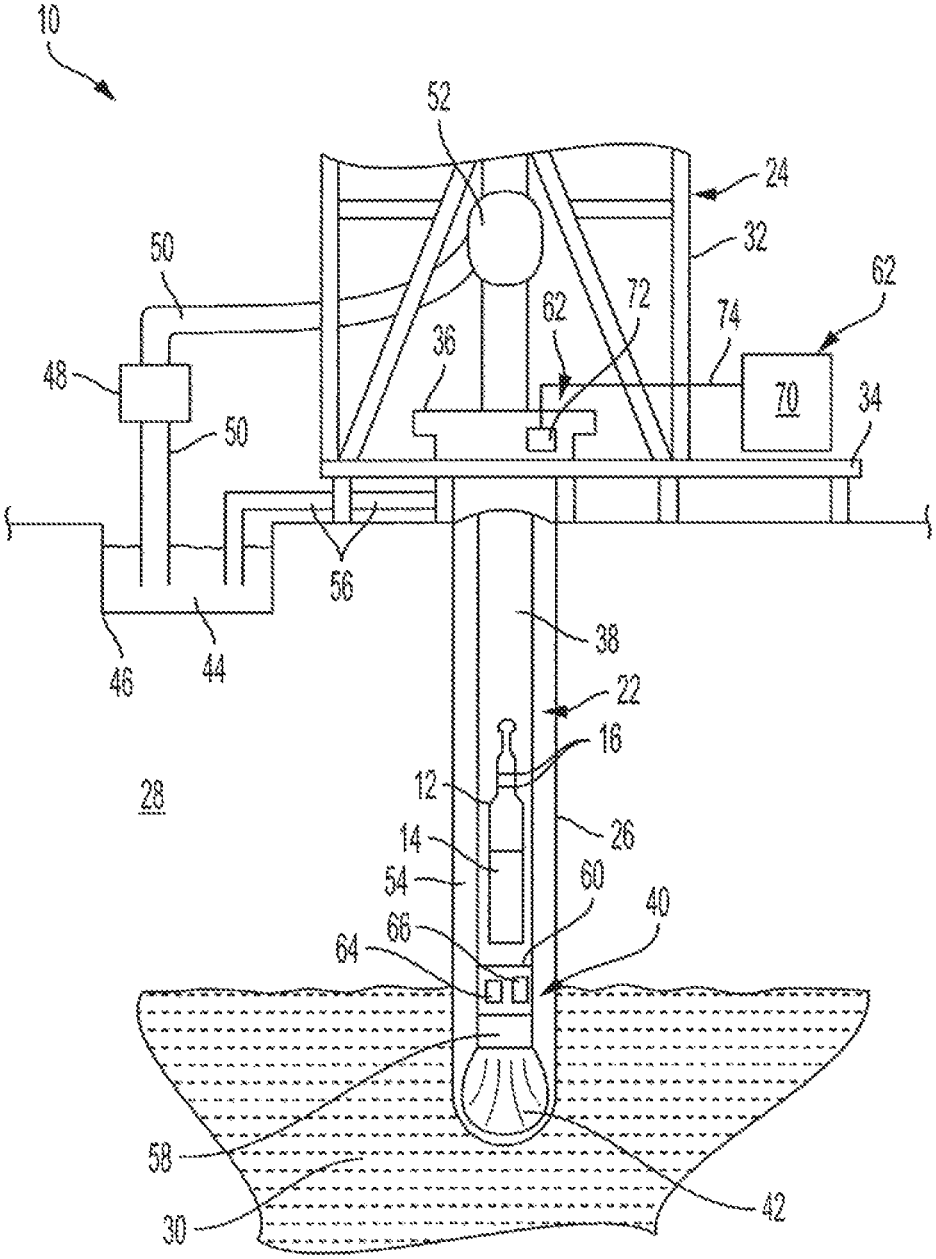
FIG. 1 is a diagram illustrating a system including a contact module configured for communicating with a downhole device, according to embodiments of the disclosure.

The present disclosure describes embodiments of a system for communicating with a device that is configured to be put down a well borehole, i.e., a downhole device. The system is used to communicate with the downhole device at the surface and with the downhole device physically connected in the downhole tool drill string, such as an MWD drill string. The system includes at least one external electrical contact in the downhole drill string. The at least one external electrical contact is configured to be electrically coupled to the downhole device to communicate with the downhole device. The at least one external electrical contact and insulators around the at least one external electrical contact are pressure sealed to prevent drilling fluid and other fluids from invading the interior of the downhole tool drill string.

In example embodiments, the system includes a contact module that is physically and electrically coupled to the downhole device in the downhole tool drill string. The contact module includes at least one external electrical contact that is electrically coupled to the downhole device for communicating with the downhole device through the at least one external electrical contact. The contact module, including the at least one external electrical contact and insulators around the at least one external electrical contact, is pressure sealed to prevent drilling fluid and other fluids from invading the interior of the contact module. This prevents the drilling fluid and other fluids from interfering with communications between the contact module and the downhole device, such as by preventing short circuits in the contact module.

The contact module can be situated anywhere in the downhole tool drill string. In embodiments, the contact module is situated at the proximal end of the downhole tool drill string. In some embodiments, the contact module is a spearpoint contact module situated at the proximal end of the downhole tool drill string and configured for lifting or raising and lowering the downhole tool drill string. In some embodiments, the contact module is situated in the middle of the downhole tool drill string, such that the contact module includes proximal and distal ends configured to be connected to other modules in the downhole tool drill string. In other embodiments, the contact module can be situated at the distal end of the downhole tool drill string. In each of the embodiments, the contact module maintains mechanical integrity in the downhole tool drill string while the downhole tool drill string is lifted or raised and lowered in the well borehole. In various embodiments, the external electrical contacts are integrated into the drilling system, rather than into a distinct contact module. In such an embodiment, for example, the external electrical contacts are integrated into any portion, component, or aspect of the MWD drill string or other downhole device.

Throughout this disclosure, a spearpoint contact module is described as an example of a contact module of the disclosure. While in this disclosure, the spearpoint contact module is used as one example of a contact module, the components, ideas, and concepts illustrated and/or described in relation to the spearpoint contact module can also be and are used in other contact modules, such as contact modules situated in the middle of the downhole tool drill string or other contact modules situated at the proximal or distal end of the downhole tool drill string.

FIG. 1 is a diagram illustrating a system 10 including a contact module 12 configured for communicating with a downhole device 14, according to embodiments of the disclosure. As shown in FIG. 1, the contact module 12 is a spearpoint. The spearpoint 12 is mechanically and electrically coupled to the device 14 and includes at least one external contact 16 for communicating with the device 14 through the at least one external contact 16. The spearpoint 12 is physically connected to the device 14 and configured for lifting at least the spearpoint 12 and the device 14. The spearpoint 12 is configured to be mechanically strong enough to maintain mechanical integrity while lifting the spearpoint 12 and the device 14. In embodiments, the device 14 gathers data downhole and stores the data for later retrieval. In embodiments, the device 14 is an MWD tool. In other embodiments, the device 14 is one or more other suitable devices, including devices that gather data downhole.

Examples described herein are described in relation to a spearpoint 12. However, in some embodiments, the mechanical and electrical aspects of the spearpoint 12, including the electrical contact configurations of the spearpoint 12, described herein, can be used in other applications and on other items. In some embodiments, the mechanical and electrical aspects of the spearpoint 12, including the electrical contact configurations of the spearpoint 12, described herein, are or can be used in other contact modules, such as contact modules situated in the middle of the downhole tool drill string or other contact modules situated at the proximal or distal end of the downhole tool drill string.

The system 10 includes a borehole drill string 22 and a rig 24 for drilling a well borehole 26 through earth 28 and into a formation 30. After the well borehole 26 has been drilled, fluids such as water, oil, and gas can be extracted from the formation 30. In some embodiments, the rig 24 is situated on a platform that is on or above water for drilling into the ocean floor.

In one example, the rig 24 includes a derrick 32, a derrick floor 34, a rotary table 36, and the drill string 22. The drill string 22 includes a drill pipe 38 and a drilling assembly 40 attached to the distal end of the drill pipe 38 at the distal end of the drill string 22. The drilling assembly 40 includes a drill bit 42 at the bottom of the drilling assembly 40 for drilling the well borehole 26.

A fluidic medium, such as drilling mud 44, is used by the system for drilling the well borehole 26. The fluidic medium circulates through the drill string 22 and back to the fluidic medium source, which is usually at the surface. In embodiments, drilling mud 44 is drawn from a mud pit 46 and circulated by a mud pump 48 through a mud supply line 50 and into a swivel 52. The drilling mud 44 flows down through an axial central bore in the drill string 22 and through jets (not shown) in the lower face of the drill bit 42. Borehole fluid 54, which contains drilling mud 44, formation cuttings, and formation fluid, flows back up through the annular space between the outer surface of the drill string 22 and the inner surface of the well borehole 26 to be returned to the mud pit 46 through a mud return line 56. A filter (not shown) can be used to separate formation cuttings from the drilling mud 44 before the drilling mud 44 is returned to the mud pit 46. In some embodiments, the drill string 22 has a downhole drill motor 58, such as a mud motor, for rotating the drill bit 42.

In embodiments, the system 10 includes a first module 60 and a second module 62 that are configured to communicate with one another, such as with the first module 60 situated downhole in the well borehole 26 and the second module 62 at the surface. In embodiments, the system 10 includes the first module 60 situated at the distal end of the drill pipe 38 and the drill string 22, and the second module 62 attached to the drill rig 24 at the proximal end of the drill string 22 at the surface. In embodiments, the first module 60 is configured to communicate with the device 14, such as through a wired connection or wirelessly.

The first module 60 includes a downhole processor 64 and a pulser 66, such as a mud pulse valve, communicatively coupled, such as by wire or wirelessly, to the downhole processor 64. The pulser 66 is configured to provide a pressure pulse in the fluidic medium in the drill string 22, such as the drilling mud 44. The second module 62 includes an uphole processor 70 and a pressure sensor 72 communicatively coupled, such as by wire 74 or wirelessly, to the uphole processor 70.

In some embodiments, the pressure pulse is an acoustic signal and the pulser 66 is configured to provide an acoustic signal that is transmitted to the surface through one or more transmission pathways. These pathways can include the fluidic medium in the drill string 22, the material such as metal that the pipe is made of, and one or more other separate pipes or pieces of the drill string 22, where the acoustic signal can be transmitted through passageways of the separate pipes or through the material of the separate pipes or pieces of the drill string 22. In embodiments, the second module 62 includes the uphole processor 70 and an acoustic signal sensor configured to receive the acoustic signal and communicatively coupled, such as by wire or wirelessly, to the uphole processor 70.

Each of the downhole processor 64 and the uphole processor 70 is a computing machine that includes memory that stores executable code that can be executed by the computing machine to perform processes and functions of the system 10. In embodiments, the computing machine is one or more of a computer, a microprocessor, and a micro-controller, or the computing machine includes multiples of a computer, a microprocessor, and/or a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, each of the first module 60 and the second module 62 includes one or more power supplies for providing power to the module.

As illustrated in FIG. 1, the spearpoint contact module 12 is physically connected to the device 14. The spearpoint 12 is made from material that is strong enough for lifting the spearpoint 12 and the device 14 from the well borehole 26 and for otherwise lifting the spearpoint 12 and the device 14. In some embodiments, the spearpoint 12 is made from one or more pieces of metal. In some embodiments, the spearpoint 12 is made from one or more pieces of steel.

The spearpoint 12 includes the at least one external contact 16 that is electrically coupled to the device 14 for communicating with the device 14 through the at least one external contact 16. In embodiments, the at least one external contact 16 is electrically coupled to the device 14 through one or more wires. In embodiments, the at least one external contact 16 is configured to provide one or more of CAN bus communications, RS232 communications, and RS485 communications between the device 14 and a surface processor.

Figure 2A:
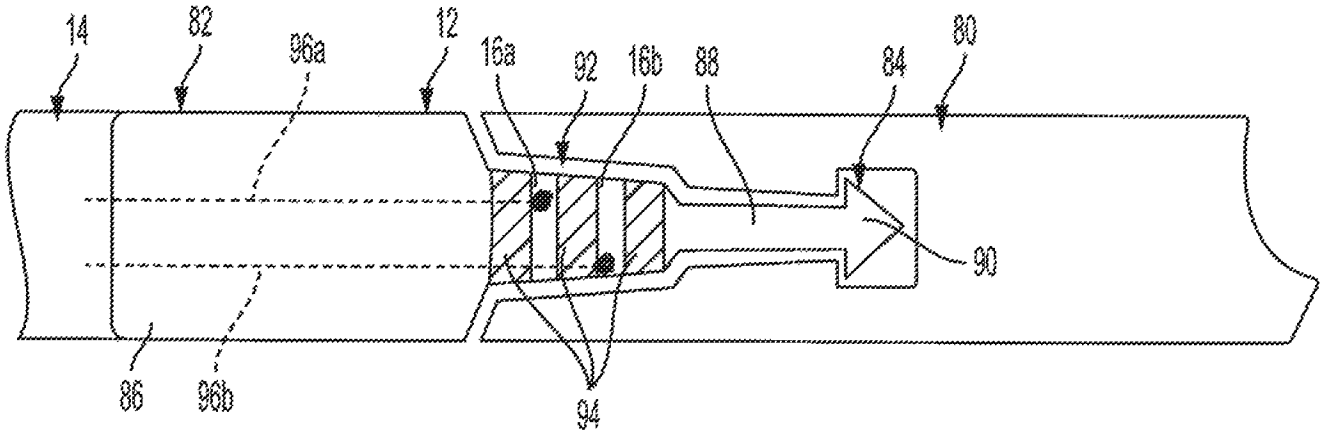
FIG. 2A is a diagram illustrating the spearpoint contact module engaged by an over shot tool for lifting the spearpoint and the device, according to embodiments of the disclosure.

FIG. 2A is a diagram illustrating the spearpoint contact module 12 engaged by an over shot tool 80 for lifting the spearpoint 12 and the device 14, according to embodiments of the disclosure. The spearpoint 12 is configured to be manipulated by a tool, such as a soft release tool, to lower the spearpoint 12 on a cable into the well borehole 26 and to release the spearpoint 22 when the spearpoint 12 has been placed into position. The over shot tool 80 is used to engage the spearpoint 12 to retrieve the spearpoint 12 from the well borehole 26 and bring the spearpoint 12 to the surface. In embodiments, the over shot tool 80 is used for lifting the spearpoint 12 and the device 14 from the well borehole 26 and/or for otherwise lifting the spearpoint 12 and the device 14.

The spearpoint 12 includes a distal end 82 and a proximal end 84. The spearpoint 12 includes an end shaft 86 at the distal end 82 and a latch rod 88 and nose 90 at the proximal end 84. The end shaft 86 is configured to be physically connected to the device 14, and the latch rod 88 and the nose 90 are configured to be engaged by the over-shot tool 80 for lifting the spearpoint 12 and the device 14. In embodiments, the end shaft 86 is configured to be threaded onto or into the device 14. In embodiments, the device 14 is an MWD tool and the end shaft 86 is configured to be threaded onto or into the MWD tool.

The spearpoint 12 further includes a contact shaft 92 situated between the end shaft 86 and the latch rod 88. The contact shaft 92 includes the at least one external contact 16 that is configured to be electrically coupled to the device 14. In this example, the contact shaft 92 includes two annular ring external contacts 16*a* and 16*b* that are each configured to be electrically coupled to the device 14 for communicating with the device 14 through the external contacts 16*a* and 16*b*. These external contacts 16*a* and 16*b* are insulated from each other and from other parts of the spearpoint 12 by insulating material 94. In some embodiments, the external contacts 16*a* and 16*b* are configured to be electrically coupled to the device 14 through wires 96*a* and 96*b*, respectively. In other embodiments, the spearpoint 12 can include one external contact or more than two external contacts.

Figure 2B:
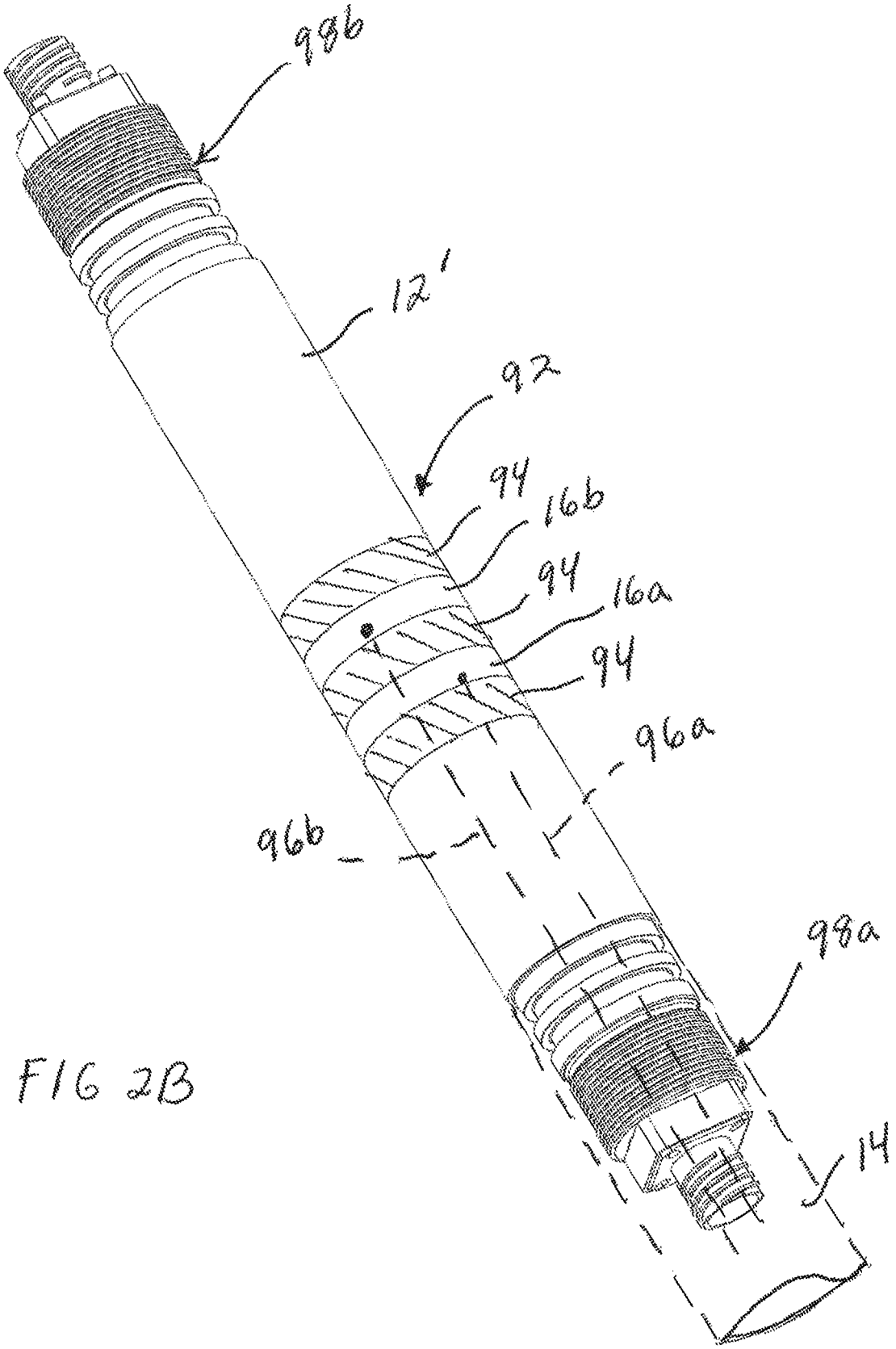
FIG. 2B is a diagram illustrating a contact module that is configured to be situated in the middle of a downhole drill string and for communicating with the downhole device, according to embodiments of the disclosure.

FIG. 2B is a diagram illustrating a contact module 12' that is configured to be situated in the middle of a downhole tool drill string and for communicating with the downhole device 14, according to embodiments of the disclosure. The contact module 12' is another example of a contact module of the present disclosure.

The contact module 12' includes a downhole or distal end 98*a* and an uphole or proximal end 98*b*. The distal end 98*a* is configured to be connected, such as by threads, onto or into the downhole device 14 or onto or into another module of the downhole tool drill string. The proximal end 98*b* is configured to be connected, such as by threads, onto or into another module of the downhole drill string, such as a retrieval tool. In embodiments, the device 14 is an MWD tool.

The contact module 12' includes a contact shaft 92 situated between the distal end 98*a* and the proximal end 98*b*. The contact shaft 92 includes the at least one external contact 16 that is configured to be electrically coupled to the device 14. In this example, the contact shaft 92 includes two annular ring external contacts 16*a* and 16*b* that are each configured to be electrically coupled to the device 14 for communicating with the device 14 through the external contacts 16*a* and 16*b*. These external contacts 16*a* and 16*b* are insulated from each other and from other parts of the contact module 12' by insulating material 94. In some embodiments, the external contacts 16*a* and 16*b* are configured to be electrically coupled to the device 14 through wires 96*a* and 96*b*, respectively. In some embodiments, the contact module 12' can include one external contact or more than two external contacts.

Figure 3:
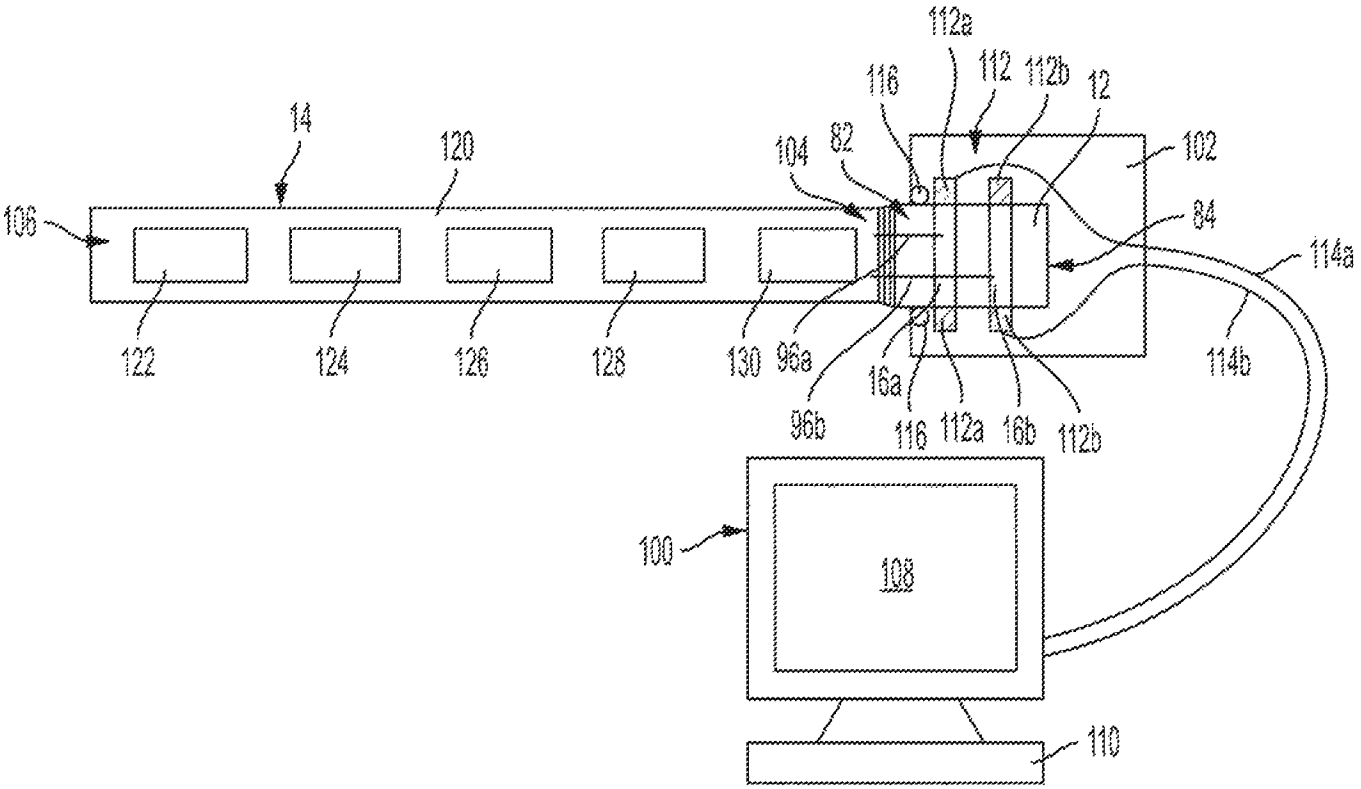
FIG. 3 is a diagram schematically illustrating a surface processor configured to communicate with the device through a surface connector and a contact module, such as a spearpoint or another contact module, according to embodiments of the disclosure.

FIG. 3 is a diagram schematically illustrating a surface processor 100 configured to communicate with a downhole device 14 through a surface connector 102 and a contact module 12, such as a spearpoint or a contact module 12', according to embodiments of the disclosure. The proximal end 84 of the spearpoint 12 is inserted into the surface connector 102 and the distal end 82 of the spearpoint 12 is physically connected, such as by threads, to the proximal end 104 of the device 14. In drilling operations, the proximal end 84 of the spearpoint 12 is situated uphole and the distal end 106 of the device 14 is situated downhole. In other embodiments, the surface connector 102 is configured to engage a different contact module, such as contact module 12', for communicating with the device 14 through the surface connector 102 and the contact module 12'.

The surface processor 100 is a computing machine that includes memory that stores executable code that can be executed by the computing machine to perform the processes and functions of the surface processor 100. In embodiments, the surface processor 100 includes a display 108 and input/output devices 110, such as a keyboard and mouse. In embodiments, the computing machine is one or more of a computer, a microprocessor, and a micro-controller, or the computing machine includes multiples of a computer, a microprocessor, and/or a micro-controller. In embodiments, the memory in the surface processor 100 includes one or more of volatile memory, such as RAM, and non-volatile memory, such as flash memory, battery-backed RAM, ROM, varieties of PROM, and disk storage. Also, in embodiments, the surface processor 100 includes one or more power supplies for providing power to the surface processor 100.

The surface connector 102 is configured to receive the spearpoint 12 and includes at least one surface electrical contact 112 that is electrically coupled to the surface processor 100 and configured to make electrical contact with the at least one external contact 16 on the spearpoint 12. In embodiments, the surface connector 102 includes multiple surface electrical contacts 112 configured to make electrical contact with corresponding external contacts 16 on the contact module, such as the spearpoint contact module 12 or the contact module 12'.

As illustrated in FIG. 3, the surface connector 102 includes two surface electrical contacts 112*a* and 112*b* that are insulated from each other and electrically coupled to the surface processor 100 by communications paths 114*a* and 114*b*, such as wires. Also, the spearpoint 12 includes two external contacts 16*a* and 16*b* that are electrically coupled to the device 14 through communications paths 96*a* and 96*b*, such as wires. The two surface electrical contacts 112*a* and 112*b* make electrical contact with the two external contacts 16*a* and 16*b* of the spearpoint 12, where surface electrical contact 112*a* makes electrical contact with the external contact 16*a* and surface electrical contact 112*b* makes electrical contact with the external contact 16*b*. Thus, the surface processor 100 is communicatively coupled to the device 14 through communications paths 114*a* and 114*b*, the two surface electrical contacts 112*a* and 112*b*, the two external contacts 16*a* and 16*b*, and communications paths 96*a* and 96*b*.

Also, in embodiments, the surface connector 102 includes one or more wiper seals 116 configured to clean the two external contacts 16*a* and 16*b* (or the at least one external contact 16) on the spearpoint 12 as the surface connector 102 is coupled onto the spearpoint 12. This wipes the two external contacts 16*a* and 16*b* clean prior to making electrical contact with the surface electrical contacts 112*a* and 112*b* of the surface connector 102.

In embodiments, the device 14 is an MWD tool 120 enclosed in one or more barrels of an MWD system string. The MWD tool 120 includes one or more of a transmitter 122, a gamma ray sensor 124, a controller 126 such as a directional controller, a sensor system 128 including one or more other sensors, and at least one battery 130. In embodiments, the transmitter 122 includes at least one of a pulser, a positive mud pulser, a negative mud pulser, an acoustic transceiver, an electromagnetic transceiver, and a piezo transceiver. In embodiments, the gamma ray sensor 124 includes at least one of a proportional gamma ray sensor, a spectral gamma ray sensor, a bulk gamma ray sensor, a resistivity sensor, and a neutron density sensor. In embodiments, the controller 126 includes at least one of a processor, power supplies, and orientation sensors.

The MWD tool 120 is configured to acquire downhole data and either transmit the value to the surface or store the downhole data for later retrieval once on the surface. The controller 126 includes a processor that is a computing machine that includes memory that stores executable code that can be executed by the computing machine to perform the processes and functions of the MWD tool 120. In embodiments, the computing machine is one or more of a computer, a microprocessor, and a micro-controller, or the computing machine includes multiples of a computer, a microprocessor, and/or a micro-controller. In embodiments, the memory is one or more of volatile memory, such as RAM, and non-volatile memory, such as flash memory, battery-backed RAM, ROM, varieties of PROM, and disk storage. Also, in embodiments, the controller 126 includes one or more power supplies for providing power to the MWD tool 120. In embodiments, the MWD tool 120 is configured to transmit at least some of the acquired data to the surface via the transmitter 122 when the MWD tool 120 is downhole.

In some embodiments, the MWD tool 120 is equipped with large, commercial grade accelerometers, such as aerospace inertial grade accelerometers, that are highly accurate sensors. Also, in some embodiments, the MWD tool 120 is equipped with fluxgate magnetometers, which are known for their high sensitivity. In some embodiments, the MWD tool 120 is an integrated tool configured to use micro electromechanical system (MEMS) accelerometers and solid-state magnetometers, which require less power and fewer voltage rails than the commercial grade sensors. Also, the MEMS accelerometers and solid-state magnetometers provide for a more compact MWD tool 120 that can be more reliable, durable, and consume less power while still providing the same level of accuracy.

In operation, the surface connector 102 is coupled to the spearpoint 12, such as by sliding the surface connector 102 onto the spearpoint 12. In some embodiments, the surface connector 102 includes the one or more wiper seals 116 that clean the two external contacts 16*a* and 16*b* on the spearpoint 12 as the surface connector 102 is slid onto the spearpoint 12. This wipes the two external contacts 16*a* and 16*b* clean prior to making electrical contact with the surface electrical contacts 112*a* and 112*b* of the surface connector 102. In some embodiments, after cleaning the two external contacts 16*a* and 16*b* by hand or with the one or more wiper seals 116, the two external contacts 16*a* and 16*b* are energized or activated for communications with the device 14.

With the surface processor 100 communicatively coupled to the device 14 through the two surface electrical contacts 112*a* and 112*b* and the two external contacts 16*a* and 16*b* of the spearpoint 12, the surface processor 100 communicates with the device 14 through the surface connector 102 and the spearpoint 12. In some embodiments, communicating with the device 14 includes one or more of CAN bus communications, RS232 communications, and RS485 communications.

Figure 4:
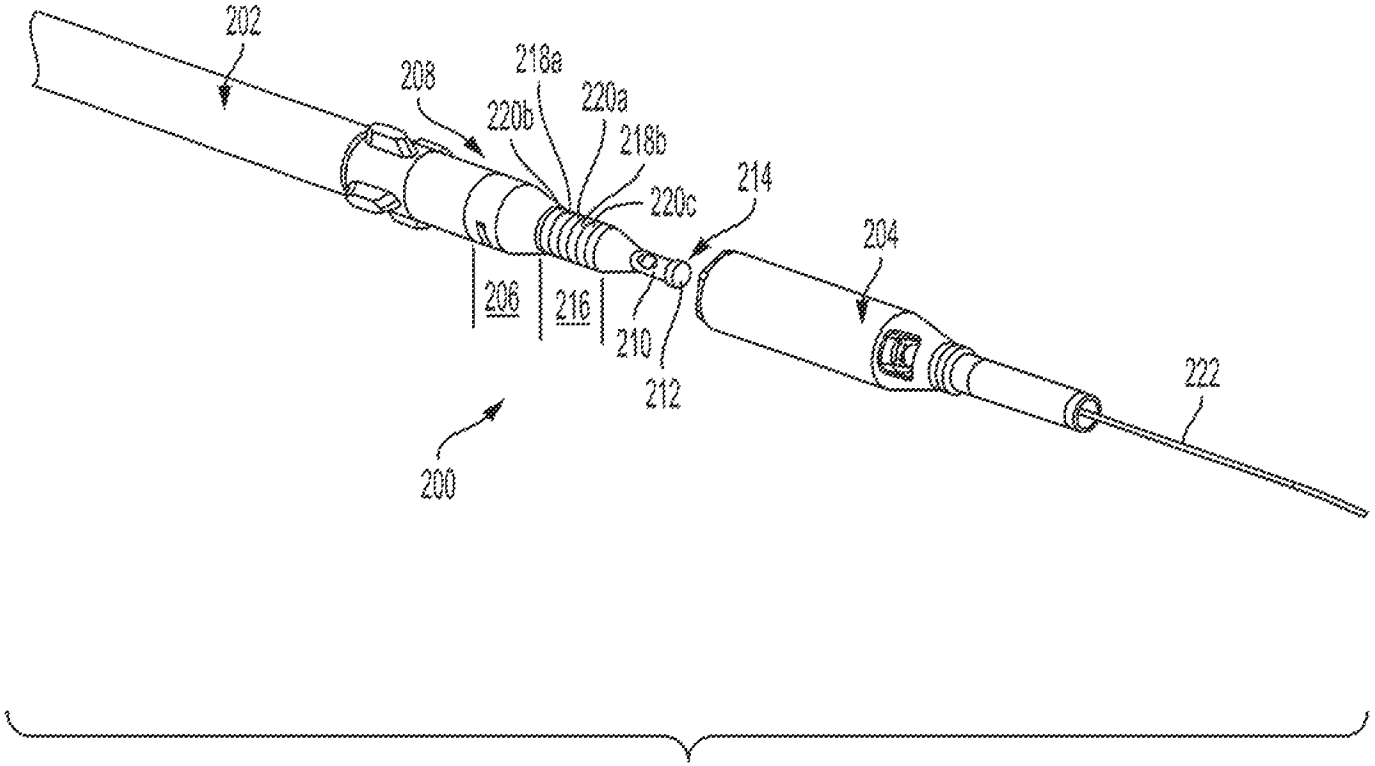
FIG. 4 is a diagram illustrating a spearpoint connected to a device and a surface connector configured to be coupled onto the spearpoint, according to embodiments of the disclosure.

FIG. 4 is a diagram illustrating a spearpoint contact module 200 connected to a device 202 and a surface connector 204 configured to be coupled onto the spearpoint 200, according to embodiments of the disclosure. In some embodiments, the spearpoint 200 is like the spearpoint 12. In some embodiments, the device 202 is like the device 14. In some embodiments, the device 202 is like the MWD tool 120. In some embodiments, the surface connector 204 is like the surface connector 102.

The spearpoint 200 includes an end shaft 206 at a distal end 208 and a latch rod 210 and nose 212 at a proximal end 214, where in drilling operations, the distal end 208 is situated downhole and the proximal end 214 is situated uphole. The end shaft 206 is physically connected to the device 202, and the latch rod 210 and the nose 212 are configured to be engaged by an over-shot tool for lifting the spearpoint 200 and the device 202. In embodiments, the end shaft 206 is configured to be threaded onto or into the device 202. In embodiments, the device 202 includes the MWD tool 120 and the end shaft 206 is configured to be threaded onto or into the MWD tool 120.

The spearpoint 200 includes a contact shaft 216 situated between the end shaft 206 and the latch rod 210. The contact shaft 216 includes two external electrical contacts 218*a* and 218*b* that are each configured to be electrically coupled to the device 202 for communicating with the device 202 through the contacts 218*a* and 218*b*. In embodiments, one or more of the contacts 218*a* and 218*b* is an annular ring electrical contact. In embodiments, the contacts 218*a* and 218*b* are electrically coupled to the device 202 through wires. In embodiments, the spearpoint 200 can include one external electrical contact or more than two external electrical contacts.

The contacts 218*a* and 218*b* are insulated from each other and from other parts of the spearpoint 200 by insulating material. The contacts 218*a* and 218*b* are insulated from each other by insulator 220*a* that is situated between the contacts 218*a* and 218*b*. Also, contact 218*a* is insulated from the end shaft 206 at the distal end 208 by insulator 220*b* and contact 218*b* is insulated from the latch rod 210 and the proximal end 214 by insulator 220*c*. In embodiments, one or more of the insulators 220*a*, 220*b*, and 220*c* is an annular ring insulator. In embodiments, one or more of the insulators 220*a*, 220*b*, and 220*c* is made from one or more of ceramic, rubber, and plastic.

The surface connector 204 is configured to receive the proximal end 214 of the spearpoint 200, including the latch rod 210 and the nose 212, and the contact shaft 216 of the spearpoint 200. The surface connector 204 includes two or more surface electrical contacts (not shown in FIG. 4) that are electrically coupled to a surface processor, such as surface processor 100, by communications path 222. These two or more surface electrical contacts are configured to make electrical contact with the spearpoint contacts 218*a* and 218*b* when the spearpoint 200 is inserted into the surface connector 204. Thus, the surface processor such as surface processor 100 is communicatively coupled to the device 202 through the two or more surface electrical contacts of the surface connector 204 and the two spearpoint contacts 218*a* and 218*b* of the spearpoint 200.

Also, in embodiments, the surface connector 204 includes one or more wiper seals that clean the spearpoint contacts 218*a* and 218*b* as the surface connector 204 is coupled onto the spearpoint 200. This wipes the spearpoint contacts 218*a* and 218*b* clean prior to making electrical contact with the surface electrical contacts of the surface connector 204.

Figure 5:
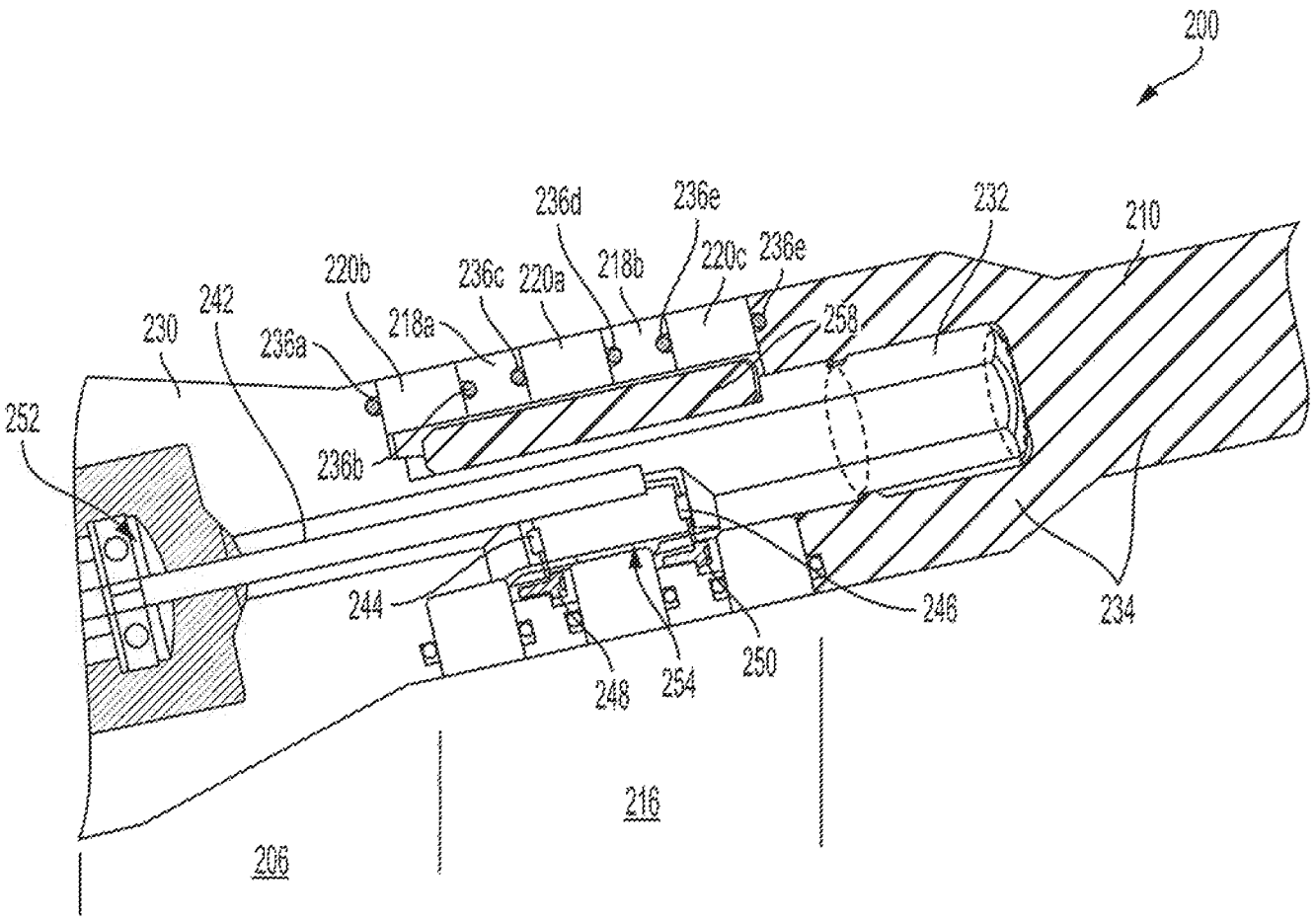
FIG. 5 is a diagram illustrating the spearpoint including at least portions of the end shaft, the contact shaft, and the latch rod, according to embodiments of the disclosure.
Figure 6:
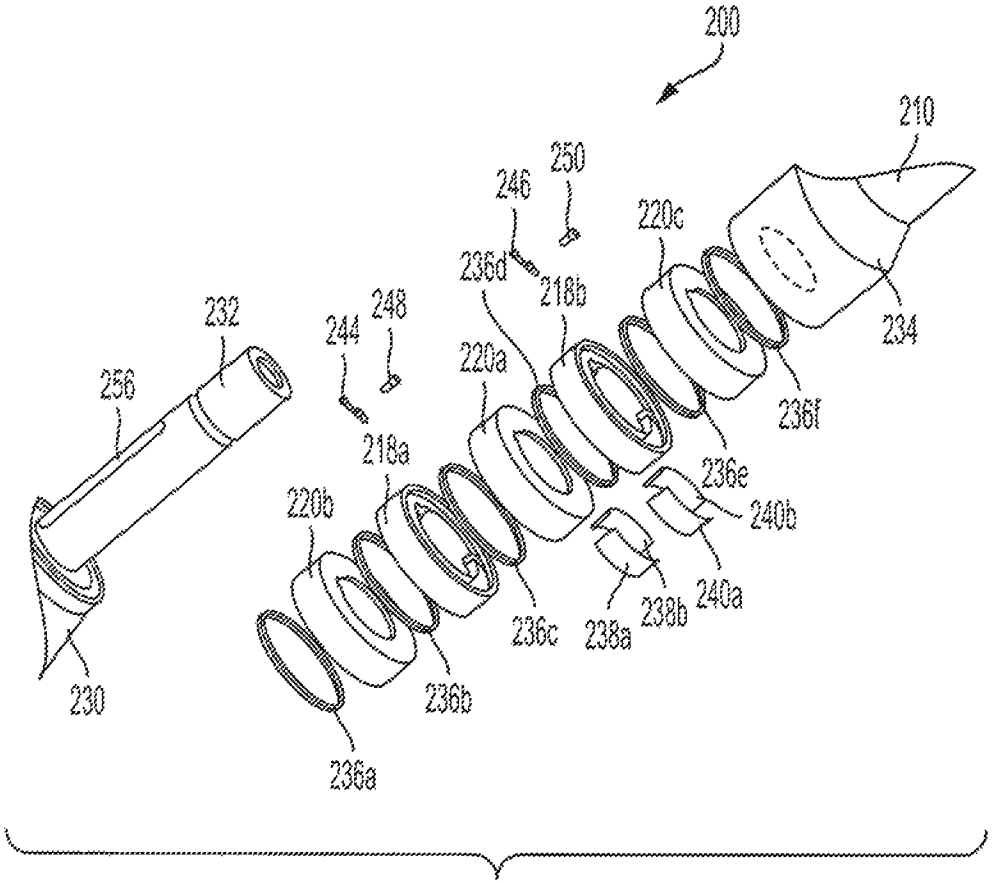
FIG. 6 is an exploded view diagram of the spearpoint shown in FIG. 5, according to embodiments of the disclosure.

FIG. 5 is a diagram illustrating the spearpoint 200 including at least portions of the end shaft 206, the contact shaft 216, and the latch rod 210, according to embodiments of the disclosure, and FIG. 6 is an exploded view diagram of the spearpoint 200 shown in FIG. 5, according to embodiments of the disclosure. As described above, the spearpoint contact module 12 is one example of a contact module of the disclosure, such that the components, ideas, and concepts illustrated and/or described in relation to the spearpoint contact module 12 can also be used in other contact modules, such as contact module 12' configured to be situated in the middle of the downhole tool drill string or other contact modules situated at the proximal or distal end of the downhole tool drill string.

Referencing FIGS. 5 and 6, the end shaft 206 includes a first member 230 that includes a central shaft 232, and the latch rod 210 includes a second member 234. The central shaft 232 of the first member 230 extends through the external electrical contacts 218*a* and 218*b* and insulators 220*a*-220*c* of the contact shaft 216 and into the second member 234. The central shaft 232 is a tensile load bearing member. The central shaft 232 engages the second member 234, such that the first member 230 and the second member 234 are secured together to maintain mechanical integrity of the spearpoint 200. In embodiments, the central shaft 232 and the second member 234 include threads, such that the central shaft 232 and the second member 234 are threaded together. In embodiments, the first member 230 is made from metal, such as steel. In embodiments, the second member 234 is made from metal, such as steel. In embodiments, the electrical contacts 218*a* and 218*b* are made from metal.

The contact shaft 216 is situated between the end shaft 206 and the latch rod 210 and includes the two external electrical contacts 218*a* and 218*b* and the three insulators 220*a*-220*c*. The contacts 218*a* and 218*b* are insulated from each other and from other parts of the spearpoint 200 by the insulators 220*a*-220*c*. The contacts 218*a* and 218*b* are insulated from each other by insulator 220*a* that is situated between the contacts 218*a* and 218*b*. Also, contact 218*a* is insulated from the end shaft 206 by insulator 220*b*, and contact 218*b* is insulated from the latch rod 210 and the second member 234 by insulator 220*c*. In embodiments, one or more of the insulators 220*a*, 220*b*, and 220*c* is made from one or more of ceramic, rubber, and plastic.

The contact shaft 216 also includes six o-ring seals 236*a*-236*f* that are situated between the contacts 218*a* and 218*b* and the insulators 220*a*-220*c*, and between insulator 220*b* and the first member 230, and insulator 220*c* and the second member 234. The o-rings 236*a*-236*f* are configured to resist or prevent fluid from invading through the contact shaft 216 and to the central shaft 232. The contacts 218*a* and 218*b*, insulators 220*a*, 220*b*, and 220*c*, and o-rings 236*a*-236*f* provide a pressure seal for the spearpoint contact module 12, such that the spearpoint 12 is pressure sealed to prevent drilling fluid and other fluids from invading the contact module. This prevents the drilling fluid and other fluids from interfering with communications between the spearpoint 12 and the downhole device 14, such as by preventing short circuits. In embodiments, one or more of the o-rings 236*a*-236*f* is made from one or more of ceramic, rubber, and plastic.

Each of the contacts 218*a* and 218*b* is an annular ring electrical contact that is slid over or onto the central shaft 232, and each of the three insulators 220*a*-220*c* is an annular ring insulator that is slid over or onto the central shaft 232. Also, each of the o-rings 236*a*-236*f* is slid over or onto the central shaft 232.

Electrical contact 218*a* is further insulated from the central shaft 232 by semicircular insulators 238*a* and 238*b* inserted between the electrical contact 218*a* and the central shaft 232, and electrical contact 218*b* is further insulated from the central shaft 232 by semicircular insulators 240*a* and 240*b* inserted between the electrical contact 218*b* and the central shaft 232. In embodiments, the semicircular insulators 238*a* and 238*b* are made from one or more of ceramic, rubber, and plastic. In embodiments, the semicircular insulators 240*a* and 240*b* are made from one or more of ceramic, rubber, and plastic.

The external electrical contacts 218*a* and 218*b* are electrically coupled to communications path 242 by electrical connectors 244 and 246, respectively. Electrical contact 218*a* is electrically coupled to connector 244, which is attached to the electrical contact 218*a* by screw 248. Electrical contact 218*b* is electrically coupled to connector 246, which is attached to the electrical contact 218*b* by screw 250. Each of the electrical connectors 244 and 246 is further electrically coupled to the communications path 242. In embodiments, each of the electrical connectors 244 and 246 is electrically coupled to an individual wire that is further electrically coupled to the device 202. In embodiments, the communications path 242 is connected to the first member 230, such as by a strain relief 252.

The central shaft 232 includes a first slot 254 that provides an opening or path for the connections of the connectors 244 and 246 to the communications path 242. The central shaft 232 includes a second slot 256 that is configured to receive a keying element or key 258. Where, in embodiments, the electrical contacts 218*a* and 218*b* are keyed such that the key 258 prevents the electrical contacts 218*a* and 218*b* and the central shaft 232 from spinning in relation to one another, which prevents twisting off the connections between the connectors 244 and 246 and the communications path 242. Thus, the first member 230 and the electrical contacts 218*a* and 218*b* are keyed to prevent rotation of the first member 230 in relation to the electrical contacts 218*a* and 218*b*. In embodiments, the key 258 includes one or more of nylon, ceramic, rubber, and plastic.

Figure 7:
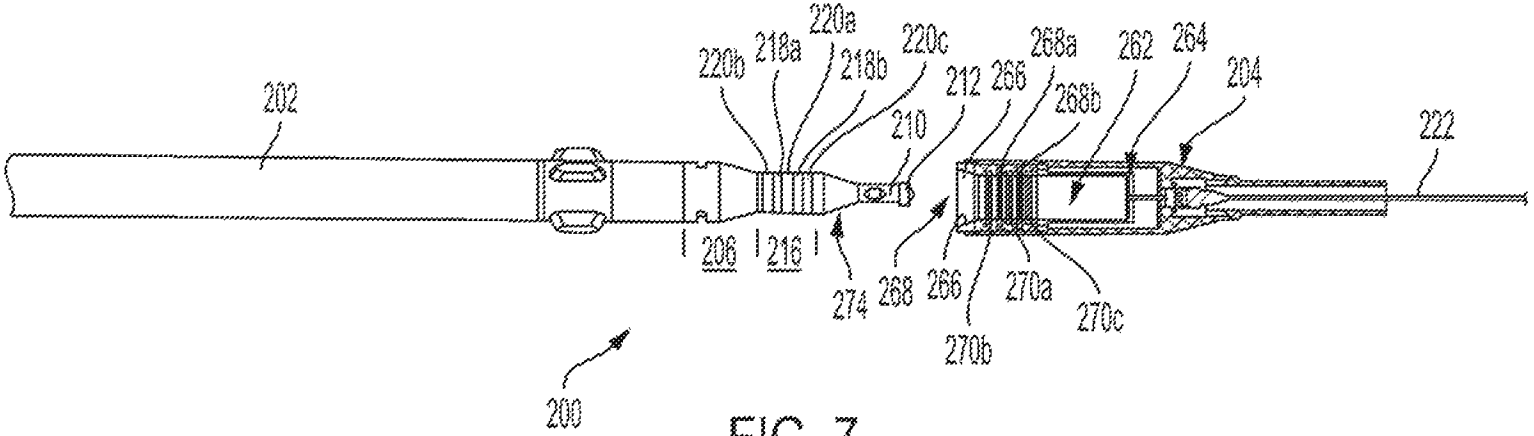
FIG. 7 is a diagram illustrating the spearpoint and the device and a cross-sectional view of the surface connector, according to embodiments of the disclosure.
Figure 8:
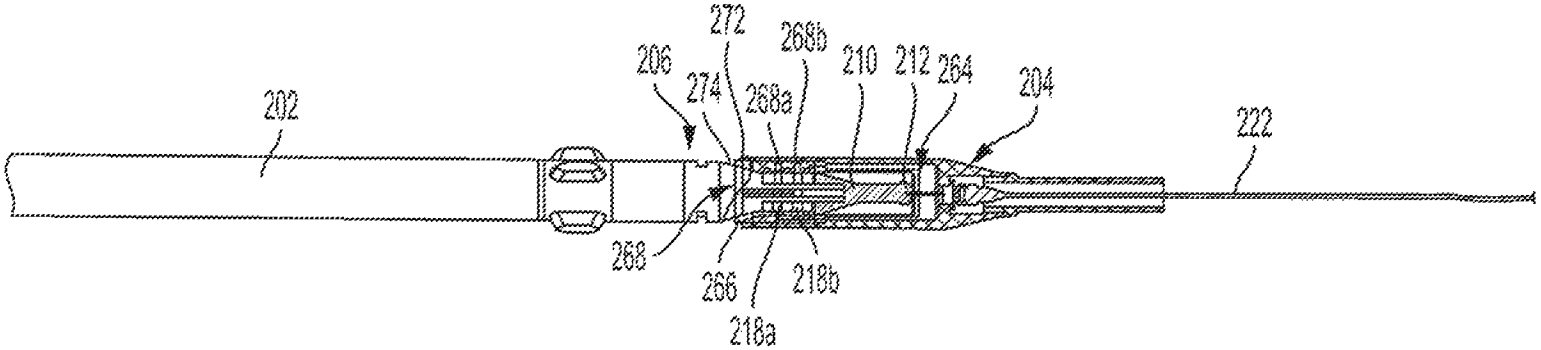
FIG. 8 is a diagram illustrating the spearpoint inserted into the surface connector and/or coupled to the surface connector, according to embodiments of the disclosure.

FIG. 7 is a diagram illustrating the spearpoint 200 and the device 202 and a cross-sectional view of the surface connector 204, according to embodiments of the disclosure. The spearpoint 200 is securely connected to the device 202, such as by threads, and not inserted into or coupled to the surface connector 204 in FIG. 7. FIG. 8 is a diagram illustrating the spearpoint 200 inserted into the surface connector 204 and/or coupled to the surface connector 204, according to embodiments of the disclosure.

Referencing FIGS. 7 and 8, the spearpoint 200 includes the end shaft 206, the contact shaft 216, and the latch rod 210 and nose 212. The end shaft 206 is physically connected to the device 202, and the contact shaft 216 includes the two external electrical contacts 218*a* and 218*b* that are each configured to be electrically coupled to the device 202 for communicating with the device 202 through the contacts 218*a* and 218*b*. In embodiments, the end shaft 206 is threaded onto or into the device 202. In embodiments, the device 202 includes the MWD tool 120 and the end shaft 206 is threaded onto or into the MWD tool 120. In other embodiments, the spearpoint 200 can include one external electrical contact or more than two external electrical contacts.

The contacts 218*a* and 218*b* are insulated from each other by insulator 220*a* that is situated between the contacts 218*a* and 218*b*. Also, contact 218*a* is insulated from the end shaft 206 at the distal end 208 by insulator 220*b*, and contact 218*b* is insulated from the latch rod 210 and the proximal end 214 by insulator 220*c*.

The surface connector 204 includes a tubular passage 262 configured to receive the latch rod 210, the nose 212, and the contact shaft 216 of the spearpoint 200. The passage 262 receives the nose 212 of the spearpoint 200 at a proximal end 264 of the passage 262, followed by the latch rod 210 and then the contact shaft 216. The surface connector 204 has angled recess portions 266 at a distal end 268 of the passage 262. These angled recess portions 266 rest on angled portions 274 of the end shaft 206 of the spearpoint 200 after or when the spearpoint 200 is inserted into the surface connector 204. In other embodiments, the surface connector 204 can be configured to engage a different contact module, such as contact module 12'.

In the present example, the surface connector 204 includes two surface electrical contacts 268*a* and 268*b* that are each electrically coupled to the surface processor, such as surface processor 100, by communications path 222. The surface electrical contacts 268*a* and 268*b* are configured to make electrical contact with the spearpoint contacts 218*a* and 218*b* when the spearpoint 200 is inserted into the surface connector 204. In embodiments, each of the surface electrical contacts 268*a* and 268*b* is an annular ring electrical contact. In embodiments, each of the surface electrical contacts 268*a* and 268*b* is sized to make electrical contact with the spearpoint contacts 218*a* and 218*b*.

The surface connector 204 further includes three spacers 270*a*-270*c* that are beside the surface electrical contacts 268*a* and 268*b*. Spacer 270*a* is situated between the surface electrical contacts 268*a* and 268*b*, spacer 270*b* is situated distal the surface electrical contact 268*a*, and spacer 270*c* is situated proximal the surface electrical contact 268*b*. In some embodiments, one or more of the spacers 270*a*-270*c* is an insulator, such as a ceramic, rubber, or plastic insulator. In some embodiments one or more of the spacers 270*a*-270*c* is a wiper seal configured to wipe the electrical contacts 218*a* and 218*b* clean.

In embodiments, the surface connector 204 includes one or more wiper seals 272 that clean the spearpoint contacts 218*a* and 218*b* as the surface connector 204 is coupled onto the spearpoint 200. This wipes the spearpoint contacts 218*a* and 218*b* clean prior to making electrical contact with the surface electrical contacts 268*a* and 268*b* of the surface connector 204.

In operation, the spearpoint 200 is inserted into the surface connector 204, such that the spearpoint contacts 218*a* and 218*b* make electrical contact with the surface electrical contacts 268*a* and 268*b* of the surface connector 204. Spearpoint contact 218*a* makes electrical contact with surface electrical contact 268*a*, and spearpoint contact 218*b* makes electrical contact with surface electrical contact 268*b*. This electrically and communicatively couples the surface processor, such as surface processor 100, to the device 202 through the surface electrical contacts 268*a* and 268*b* and the spearpoint contacts 218*a* and 218*b*. The surface processor communicates with the device 202, such as by programming the device 202 or downloading data from the device 202. In embodiments, the surface processor and the device 202 communicate using one or more of single line communications, CAN communications, RS232 communications, and RS485 communications.

Figure 9:
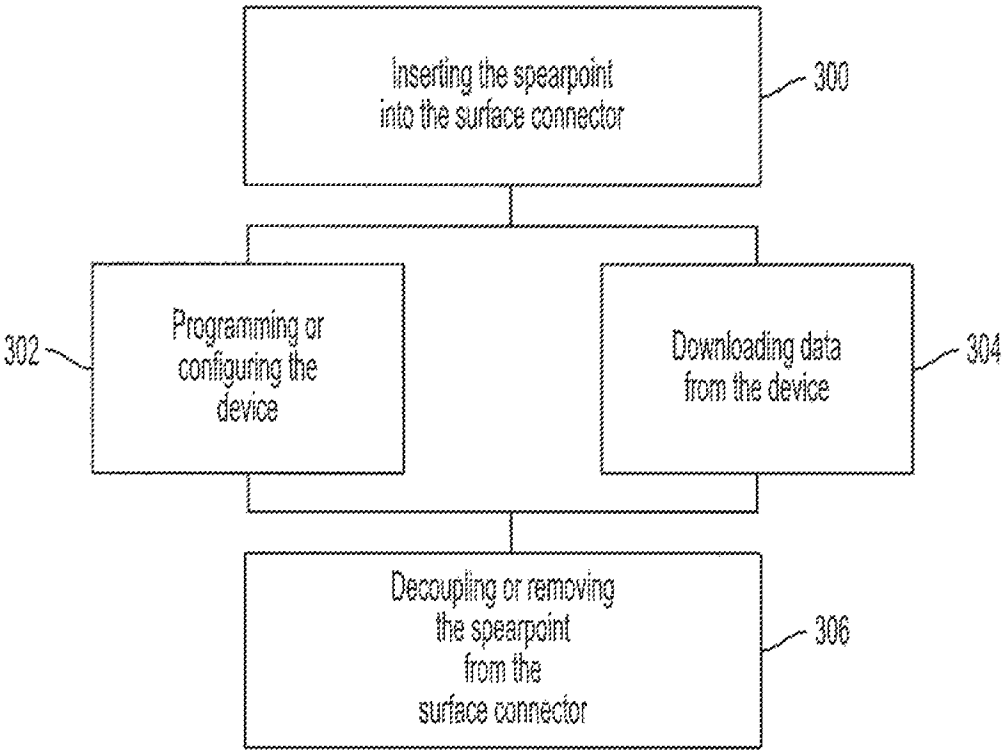
FIG. 9 is a flow chart diagram illustrating a method of communicating with a device, such as a drill string tool, through a contact module, such as a spearpoint contact module, according to embodiments of the disclosure.

FIG. 9 is a flow chart diagram illustrating a method of communicating with a device 202, such as a drill string tool, through a contact module, such as spearpoint contact module 200, according to embodiments of the disclosure. In other example embodiments, the mechanical and electrical aspects of the spearpoint 200, including the electrical contact configurations of the spearpoint 200 described herein can be used in other contact modules, such as contact module 12'. In other example embodiments, the mechanical and electrical aspects of the spearpoint 200, including the electrical contact configurations of the spearpoint 200 described herein can be used in other applications and on other items, such as EM head and rotator connector (wet connect) applications.

To begin, at 300, the method includes inserting the spearpoint 200 into the surface connector 204 at the surface without disconnecting the spearpoint 200 from the device 202. With insertion, the spearpoint contacts 218*a* and 218*b* make electrical contact with the surface electrical contacts 268*a* and 268*b*, such that spearpoint contact 218*a* makes electrical contact with surface electrical contact 268*a*, and spearpoint contact 218*b* makes electrical contact with surface electrical contact 268*b*. The surface connector 204 can be connected to the surface processor either before or after the spearpoint 200 is inserted into the surface connector 204.

This results in the surface processor being electrically and communicatively coupled to the device 202 through the surface electrical contacts 268*a* and 268*b* and the spearpoint contacts 218*a* and 218*b*. In some embodiments, inserting the spearpoint 200 into the surface connector 204 wipes the spearpoint contacts 218*a* and 218*b* clean prior to making electrical contact with the surface electrical contacts 268*a* and 268*b* of the surface connector 204.

The surface processor then communicates with the device 202 by performing at least one of programming or configuring the device 202, at 302, and downloading data from the device 202, at 304. In embodiments, the surface processor and the device 202 communicate using one or more of single line communications, CAN communications, RS232 communications, and RS485 communications.

At 306, the spearpoint 200 is decoupled or removed from the surface connector 304, and then returned to normal surface.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

The following is claimed:

1. A downhole tool, comprising:

a spear point assembly comprising an axis, an end shaft having a distal end configured to be coupled to a downhole device, a central shaft extending axially from the end shaft, a latch rod threadingly coupled to a proximal end of the central shafts;

electrical contacts and insulators located on an exterior of the central shaft, such that the central shaft extends through the electrical contacts and insulators and into the latch rod, the electrical contacts are configured to be electrically coupled to the downhole device, and electrically coupled with a surface connector in a slidable axial direction, each of the end shaft, electrical contacts, insulators, and latch rod comprise axial faces, and physical contact between the electrical contacts, insulators, end shaft and latch rod consists of contact between the respective axial faces thereof;

seal apertures located only in the axial faces of the end shaft, electrical contacts and latch rod, such that the insulators are free of seal apertures;

o-ring seals positioned exclusively in the seal apertures in the axial faces of the electrical contacts, end shaft and latch rod; and the latch rod comprises a spear tip nose at a distal end thereof configured to stab into a female receptacle in a overshot tool to carry an entire weight of the spear point assembly and the downhole device at the spear tip nose to be retrieved from a well, such that an entire tensile load connection and capacity of the spear point assembly consists of the spear tip nose.

2. The downhole tool of claim 1, wherein the electrical contacts are electrically insulated from each other and from the end shaft and latch rod by the insulators.

3. The downhole tool of claim 1, wherein each of the electrical contacts is an annular metal ring that completely circumscribes the central shaft, and each of the insulators is an annular ceramic ring that completely circumscribes the central shaft.

4. The downhole tool of claim 1, further comprising semicircular electrical insulators located between the electrical contacts, respectively, and the central shaft.

5. The downhole tool of claim 1, wherein the electrical contacts are electrically coupled to a communications path with electrical connectors, respectively, via fasteners.

6. The downhole tool of claim 5, wherein the communications path is connected to the end shaft via a strain relief.

7. The downhole tool of claim 5, wherein the central shaft comprises a connections slot for connecting the electrical connectors to the communications path.

8. The downhole tool of claim 5, wherein the central shaft comprises a key slot having a key that engages and limits the electrical contacts from rotation relative to the axis and the end shaft.

9. A downhole tool, comprising:

a spear point assembly comprising an axis, an end shaft having a distal end configured to be coupled to a downhole device, a central shaft extending axially from the end shaft, a latch rod threadingly coupled to a distal end of the central shaft, electrical contacts and insulators located on an exterior of the central shaft, such that the central shaft extends through the electrical contacts and insulators and into the latch rod, the electrical contacts are configured to be electrically coupled to the downhole device, and electrically coupled with a surface connector in a slidable axial direction, and the electrical contacts are electrically insulated from each other and from the end shaft and latch rod by the insulators;

each of the end shaft, electrical contacts, insulators, and latch rod comprise axial faces, and physical contact between the electrical contacts, insulators, end shaft and latch rod consists of contact between the respective axial faces thereof;

seal apertures located only in the axial faces of the end shaft, electrical contacts and latch rod, such that the insulators are free of seal apertures;

o-ring seals positioned exclusively in the seal apertures in the axial faces of the electrical contacts, end shaft and latch rod; and the latch rod comprises a spear tip nose at a proximal end thereof configured to stab into a female receptacle in a overshot tool to carry an entire weight of the spear point assembly and the downhole device at the spear tip nose to be retrieved from a well, such that an entire tensile load connection and capacity of the spear point assembly consists of the spear tip nose.

10. The downhole tool of claim 9, wherein each of the electrical contacts is an annular metal ring that completely circumscribes the central shaft, and each of the insulators is an annular ceramic ring that completely circumscribes the central shaft.

11. The downhole tool of claim 9, further comprising semicircular electrical insulators located between the electrical contacts, respectively, and the central shaft.

12. The downhole tool of claim 9, wherein the electrical contacts are electrically coupled to a communications path with electrical connectors, via fasteners;

the central shaft comprises a connections slot to connect the electrical connectors to the communications path; and the central shaft comprises a key slot having a key that engages and limits the electrical contacts from rotation relative to the axis and the end shaft.

13. A downhole tool, comprising:

a spear point assembly comprising an axis, an end shaft having a distal end configured to be coupled to a downhole device, a central shaft extending axially from the end shaft, a latch rod threadingly coupled to a distal end of the central shaft, electrical contacts and insulators located on an exterior of the central shaft, such that the central shaft extends through the electrical contacts and insulators and into the latch rod, the electrical contacts are configured to be electrically coupled to the downhole device, and electrically coupled with a surface connector in a slidable axial direction, each of the end shaft, electrical contacts, insulators, and latch rod comprise axial faces, and physical contact between the electrical contacts, insulators, end shaft and latch rod consists of contact between the respective axial faces thereof;

seal apertures located only in the axial faces of the end shaft, electrical contacts and latch rod, such that the insulators are free of seal apertures;

o-ring seals positioned exclusively in the seal apertures in the axial faces of the electrical contacts, end shaft and latch rod;

the electrical contacts are electrically coupled to a communications path with electrical connectors, respectively, via fasteners;

the central shaft comprises a key slot having a key that engages and limit the electrical contacts from rotation relative to the axis and the end shaft; and the latch rod comprises a spear tip nose at a proximal end thereof configured to stab into a female receptacle in a overshot tool to carry an entire weight of the spear point assembly and the downhole device at the spear tip nose to be retrieved from a well, such that an entire tensile load connection and capacity of the spear point assembly consists of the spear tip nose.

14. The downhole tool of claim 13, wherein each of the electrical contacts is an annular metal ring that completely circumscribes the central shaft, and each of the insulators is an annular ceramic ring that completely circumscribes the central shaft.

15. The downhole tool of claim 13, wherein the communications path is connected to the end shaft via a strain relief; and the central shaft comprises a connections slot for connections of the electrical connectors to the communications path.

* * * * *